US006044984A

United States Patent [19]

Crosby et al.

[11] Patent Number: 6,044,984

[45] Date of Patent: Apr. 4, 2000

[54] TOOL RACK WITH MOUNTS

[75] Inventors: Jim Crosby, Groveland; David Lichtbach, Whittier; Eric Lichtbach, Downey, all of Calif.

[73] Assignee: Renu Plating, Inc., Commerce, Calif.

[21] Appl. No.: 09/033,039

[22] Filed: Mar. 2, 1998

[51] Int. Cl.[7] ..... A47F 7/00

[52] U.S. Cl. ..... 211/70.6; 211/4

[58] Field of Search ..... 211/4, 13.01, 70.6, 211/87.01

[56] References Cited

U.S. PATENT DOCUMENTS

| | | | |
|---|---|---|---|
| 1,769,174 | 7/1930 | Burks et al. . | |
| 1,914,276 | 6/1933 | Moore . | |
| 2,041,749 | 5/1936 | Fischer | 211/70.6 |
| 2,046,815 | 7/1936 | Fike . | |
| 2,119,217 | 5/1938 | Rocchi | 211/70.6 |
| 2,291,381 | 7/1942 | Drake . | |
| 2,344,540 | 3/1944 | Dowd . | |
| 3,893,568 | 7/1975 | Lile | 211/70.6 |
| 3,980,217 | 9/1976 | Yochum | 211/70.6 |
| 4,467,925 | 8/1984 | Ratzloff et al. . | |
| 5,086,935 | 2/1992 | Gallagher . | |
| 5,224,609 | 7/1993 | Bauer et al. | 211/87.01 |

*Primary Examiner*—Daniel P. Stodola
*Assistant Examiner*—Jennifer E. Novosad
*Attorney, Agent, or Firm*—Ladas & Parry

[57] ABSTRACT

A tool rack for storing and fully securing tools within one or more tool mounts on the tool rack. The tool rack has at least one hinged tool mount, a part of which is rotated from a first position where a tool mounted within the hinged tool mount may be removed from the hinged tool mount to a second position where the tool may not be removed from the hinged tool mount. U-shaped clips are attached to or near one or more of the tool mounts to further secure the tools within the mounts. One or more tool mounts on the tool rack have shrouds which cover a substantial area of a tool placed within the shrouded tool mounts. The shrouds and U-shaped clips have bent ends to guide tools into their respective tool mounts. Tool mount placement and arrangement on the tool rack facilitate space-saving tool arrangement on the tool rack, with tool heads being protected not only by tool shrouds, but also by parts of other tools installed within the tool rack.

15 Claims, 13 Drawing Sheets

TOOL RACK WITH MOUNTS

FIELD OF THE INVENTION

This invention relates to the field of utility racks, and more particularly, to utility racks in which tools (such as axes, sledgehammers, or shovels) are stored and secured.

BACKGROUND

Whether at a worksite, in a vehicle, or at home, unstored and unsecured tools present obvious problems: disorganization, potential damage to tools, tool loss or theft, and even danger to those working or near such tools. For example, the practice of keeping a shovel and an axe loose within a truck presents opportunities for these tools to be stolen, to be damaged, or to cause injury during truck movement.

A number of devices have been developed which attempt to store and secure tools in a variety of ways. For example, a common type of tool rack relies upon gravity to hold stored tools in proper position on the tool rack. Tools in this type of rack are suspended by their tool heads (e.g., in the case of an axe or hammer, suspended by the axe head and hammer head, respectively), leaving their handles to rest in a vertical position from the force of gravity. However, this type of tool rack is inappropriate where the tool rack orientation may be changed often (such as where the tool rack is mounted on a vehicle) or where several different rack mounting orientations are desired.

Other types of tool racks attempt to more fully secure the tools they house by securing the tools at both ends. However, these tool racks suffer from other deficiencies. For example, the means by which these tool racks hold tool ends are often difficult to manipulate, requiring significant time to ready the tool rack for placing a tool within the rack, to insert the tool properly in place within the tool rack, and to secure the tool within the tool rack. Furthermore, a number of the means by which these tool racks secure tools within their racks do not easily permit a user to lock the tools in place (against theft or unauthorized use of the tools). Also, due to significant design limitations, a number of these tool racks only permit a particular tool shape or range of tool shapes to fit within their racks. Finally, a serious problem rarely addressed by conventional tool racks is space limitation. Few tool racks are designed with an eye toward optimizing the space occupied by tools within their racks. The placement and arrangement of tools within such racks is often at the expense of efficient tool rack size and tool protection (from tool damage and from injury to others near the tool rack).

While the prior tool rack designs may deal with storing and/or securing tools, none adequately provide for a tool rack which fully secures tools within the rack, provides protection from unauthorized tool removal, offers a tool mounting design in which tools may be quickly and easily mounted and removed from the tool rack, accepts a wide variety of tool shapes and types, optimizes tool space, and protects against damage to tools and by tools stored within the rack. What is needed is a tool rack which has a simple, inexpensive design and which achieves all the aforementioned objectives. The invention as described herein provides such a design and meets these objectives.

SUMMARY OF THE INVENTION

An apparatus and method for securing tools within a tool rack is provided, which includes one or more mounts adapted to receive at least a part of a tool to be stored and secured within the tool rack. Preferably, multiple tool rack mounts are fixed in place relative to one another and secure tools at both ends of each tool. At least one tool mount on the tool rack is hinged to move from a first position wherein a tool within the tool mount may be removed from the tool mount, to a second secured position wherein removal of the tool from the tool mount is obstructed. The hinged mount may move together with the tool part secured in the mount as the tool mount is moved in its secured position, or may instead be moved to its secured position without moving the tool within the mount. To secure tools within the tool mount(s), U-shaped clips may be secured relative to the tool mounts (either within or beside the tool mounts).

One or more mounts on the tool rack may have shrouds which cover a substantial part of the tool secured within the mount(s), thereby holding the mounted tools in place, protecting the tools from damage while in the tool rack, and preventing injury from others near the tool rack. For ease and speed of tool mounting, the ends of the U-shaped clips and the shrouds may be bent such that tools are guided into place within their respective mounts. One or more mounts may be adapted to receive the shackle of a lock to thereby lock the mount(s) in place to prevent unauthorized removal of tools from the tool rack. The arrangement and placement of tools within the tool rack (determined by the arrangement and placement of the tool mounts in the tool rack) are space-optimizing, and protect the tool heads by shielding them with parts of other tools within the tool rack.

DETAILED DESCRIPTION

Figure 1:
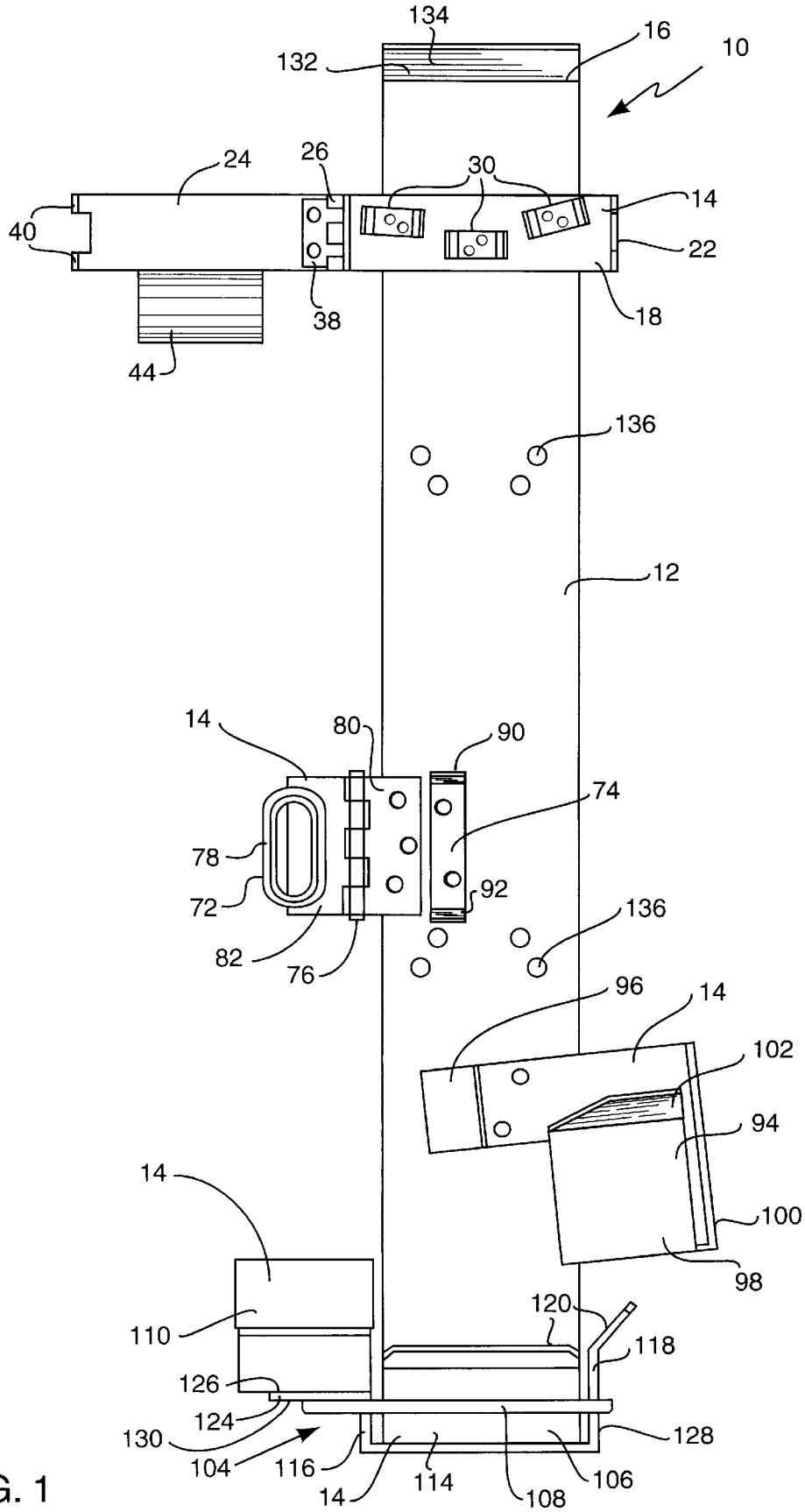
FIG. 1 is a front view of a preferred embodiment of the present invention, showing two hinged tool mounts (a hinged upper mount and a hinged mattock blade mount) both in their open positions.
Figure 2:
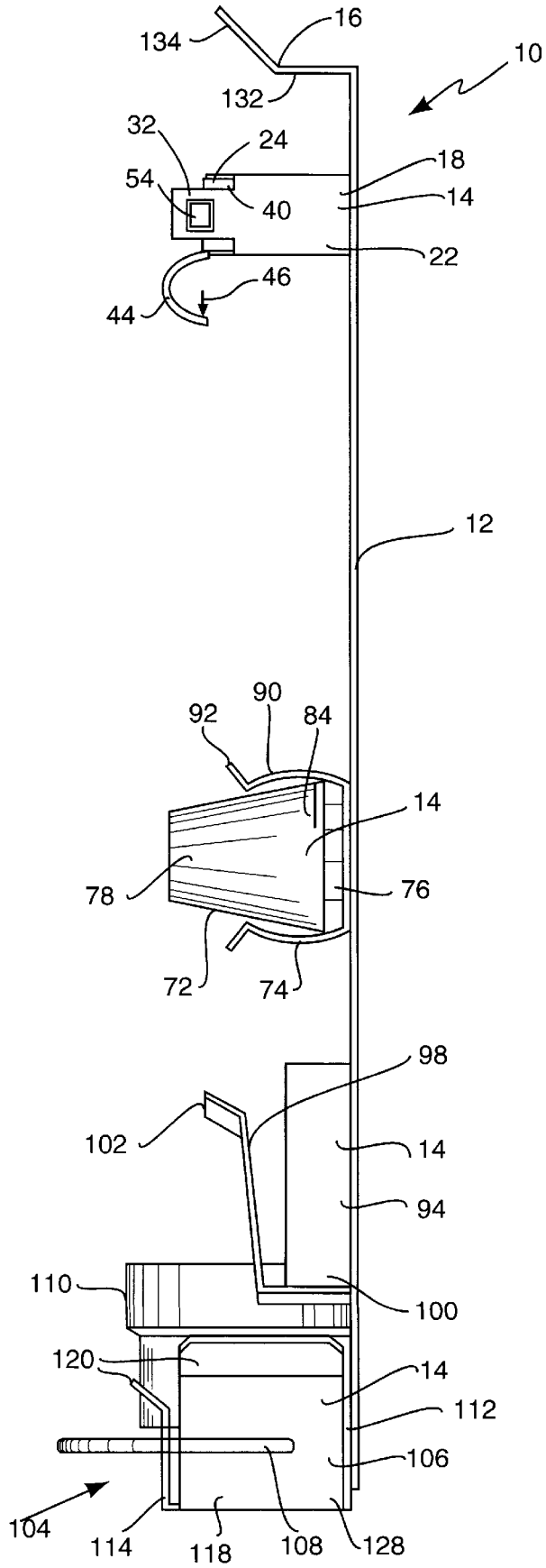
FIG. 2 is a side view of the tool rack shown in FIG. 1, but with the hinged upper mount in its closed position.

FIGS. 1 and 2 show front and side views of a preferred embodiment of the present invention. The preferred embodiment tool rack described below holds a sledgehammer, an axe, a mattock blade and handle, and a shovel. However, other tool racks holding other tools in alternate arrangements are possible. The preferred embodiment described below is not introduced by way of limitation, but by way of example, illustrating one possible tool rack embodying the mounting and tool arrangement elements and features of the present invention.

The tool rack of FIGS. 1 and 2, indicated generally at 10, includes backplate 12 onto which a number of tool mounts 14 are attached. Backplate 12 and tool mounts 14 are made from steel, but other materials are possible, such as plastics, composites, wood, or other metals. Backplate 12 is made from ⅛" plate steel which has been bent at bend locations 16, the purpose of which will be described later.

Figure 3:
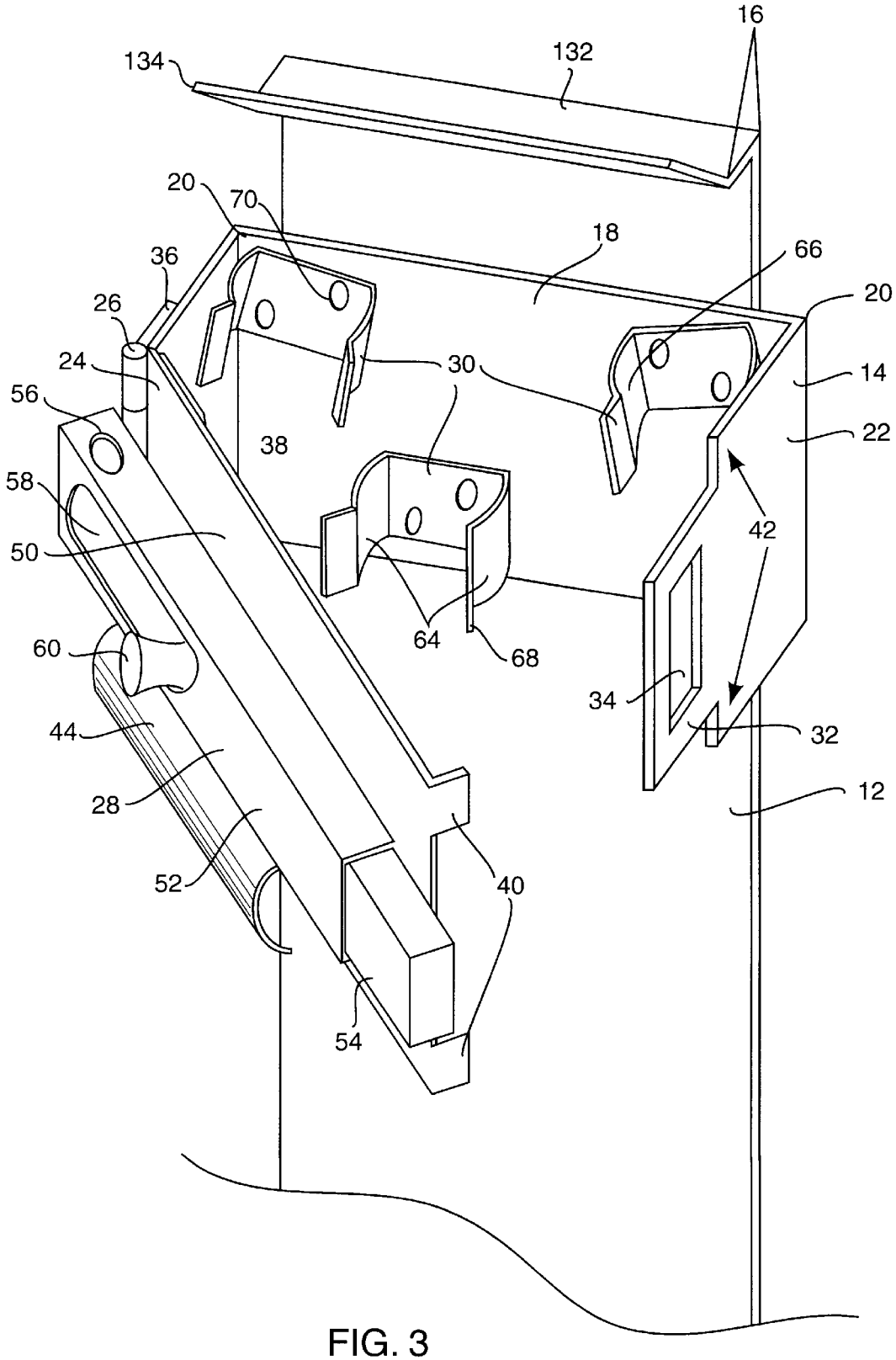
FIG. 3 is a closeup view of the hinged upper mount (partially opened) shown in FIGS. 1 and 2.

Upper mount 18 is also made from ¼" plate steel bent at locations 20 (see FIG. 3). Upper mount 18 is made of enclosure 22, door 24 secured to enclosure 22 by hinge 26, bolt assembly 28, and handle clips 30. Enclosure 22 is U-shaped, with the lower part of the U shape being welded to backplate 12. Extending from one end of enclosure 22 is arm 32, which has a capture hole 34 (used in connection with bolt assembly 28 as described in more detail below). On an opposite end of enclosure 22 is attached one plate 36 of hinge 26. The second plate 38 of hinge 26 is attached to one end of door 24. Hinge plates 36, 38 are attached to enclosure 22 and door 24, respectively, by welding.

On an end opposite the point of attachment to hinge plate 38, door 24 is provided with two flanges 40, which overlap areas 42 of enclosure 22 when door 24 is in its closed position, thus causing door 24 to stop in proper position for bolting of bolt assembly 28. The lower end 44 of door 24 is bent in a curved shape such that the concave face of lower end 44 faces backplate 12 when door 24 is closed. In the preferred embodiment, the radius of curvature 46 (see FIG. 2) of lower end 44 is approximately 0.75"

Bolt assembly 28 is attached to the exterior surface 50 of door 24 by welding. Bolt assembly 28 includes housing 52, bolt 54, shackle hole 56, slide hole 58, and handle 60, and is one type of bolt assembly which is well-known in the art. One such bolt assembly 28 manufactured by Stanley Corporation is Stanley model number 76-3808 ("Pad Lockable Spring Bolt"). Bolt 54 of bolt assembly 28 slides axially within housing 52. By grasping handle 60 (which is itself attached to bolt 54 and extends through slide hole 58), a user may move the bolt from a retracted position to an extended position as shown in FIG. 3. In this manner, when door 24 is closed, a user may grasp handle 60, slide bolt 54 to its extended position (to the right in FIG. 3) in which bolt 54 passes through capture hole 34 to lock door 24 over enclosure 22. To prevent door 24 from being opened by those without permission to use tools stored within tool rack 10, bolt 54 may be locked in its extended locking position by the shackle of a lock (not shown) passed through shackle hole 56.

Clips 30 are U-shaped, and are preferably made of 1/16" bent plate steel. The sides of each clip 30 form arms 64 which extend away from backplate 12. Each pair of arms 64 are curved such that the interior surface 66 of each arm is concave. Each arm 64 terminates in a reverse bend 68. Clips 30 are spot welded or riveted 70 to backplate 12 at the lowest part of their U shape. As can be seen in FIG. 3, two of the three clips 30 are attached at an angle to the longitudinal axis of backplate 12. The purpose of this arrangement is to align clips 30 with the handles of tools mounted within tool rack 10, not all of which will be oriented parallel to the longitudinal axis of backplate 12 (see FIG. 12). By virtue of their shape and thickness, arms 64 of clips 30 may be bent slightly without permanent deformation of clips 30. When a tool handle is pressed into a clip 30, the reverse bends 68 of arms 64 guide the tool handle into the center of clip 30. As the tool handle is further pushed, arms 64 spread apart due to their flexibility, allowing the handle to "snap" into the center of clip 30. The resiliency and curved shape of arms 64 secures the tool handle fly in place between arms 64. Though clips 30 are preferably made from steel, other materials (such as plastics, composites, or other metals) exhibiting the necessary strength, flexibility and resiliency may also be used.

Figure 4:
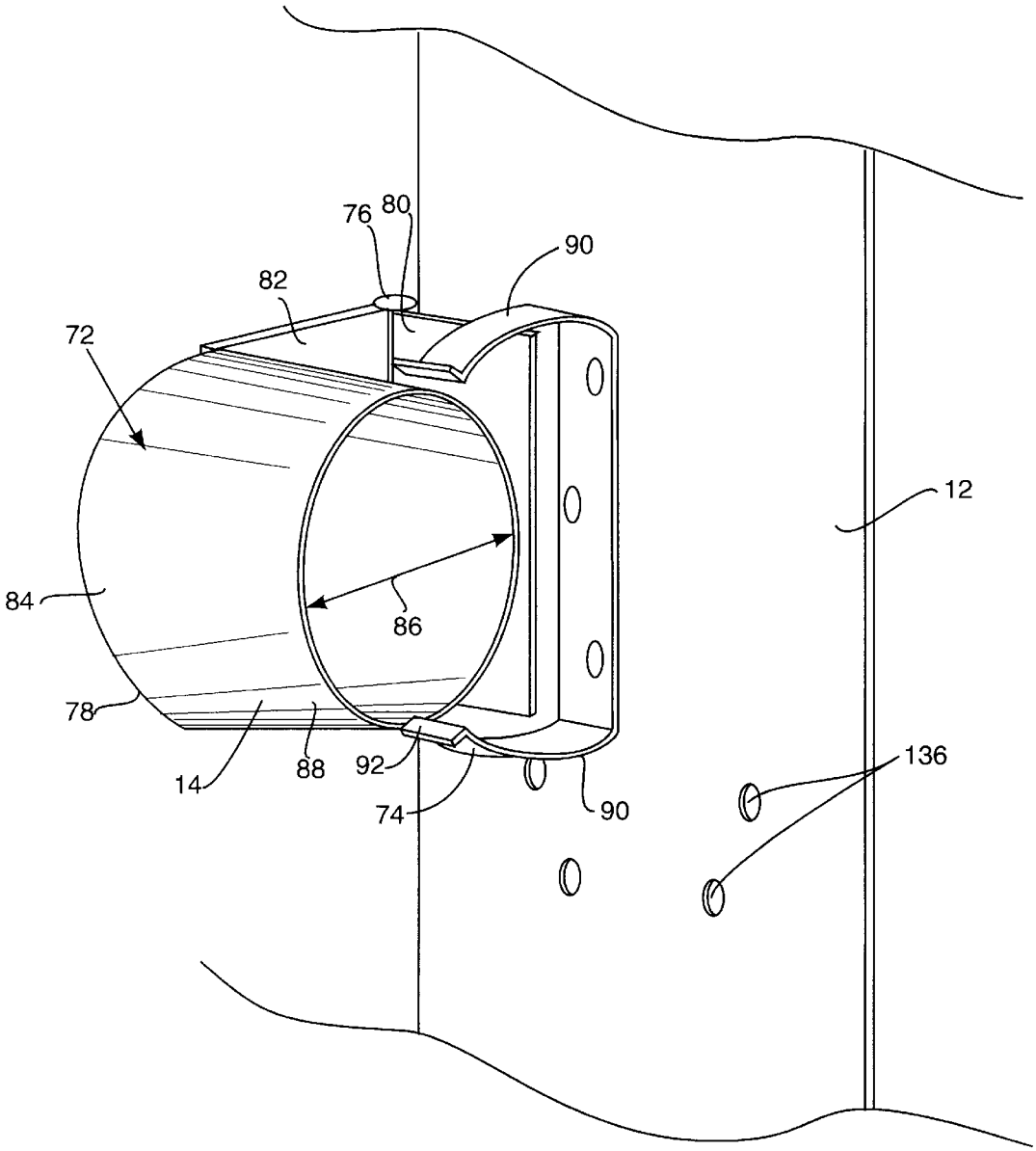
FIG. 4 is a closeup view of the hinged mattock blade mount (in its closed position) shown in FIGS. 1 and 2.
Figure 8:
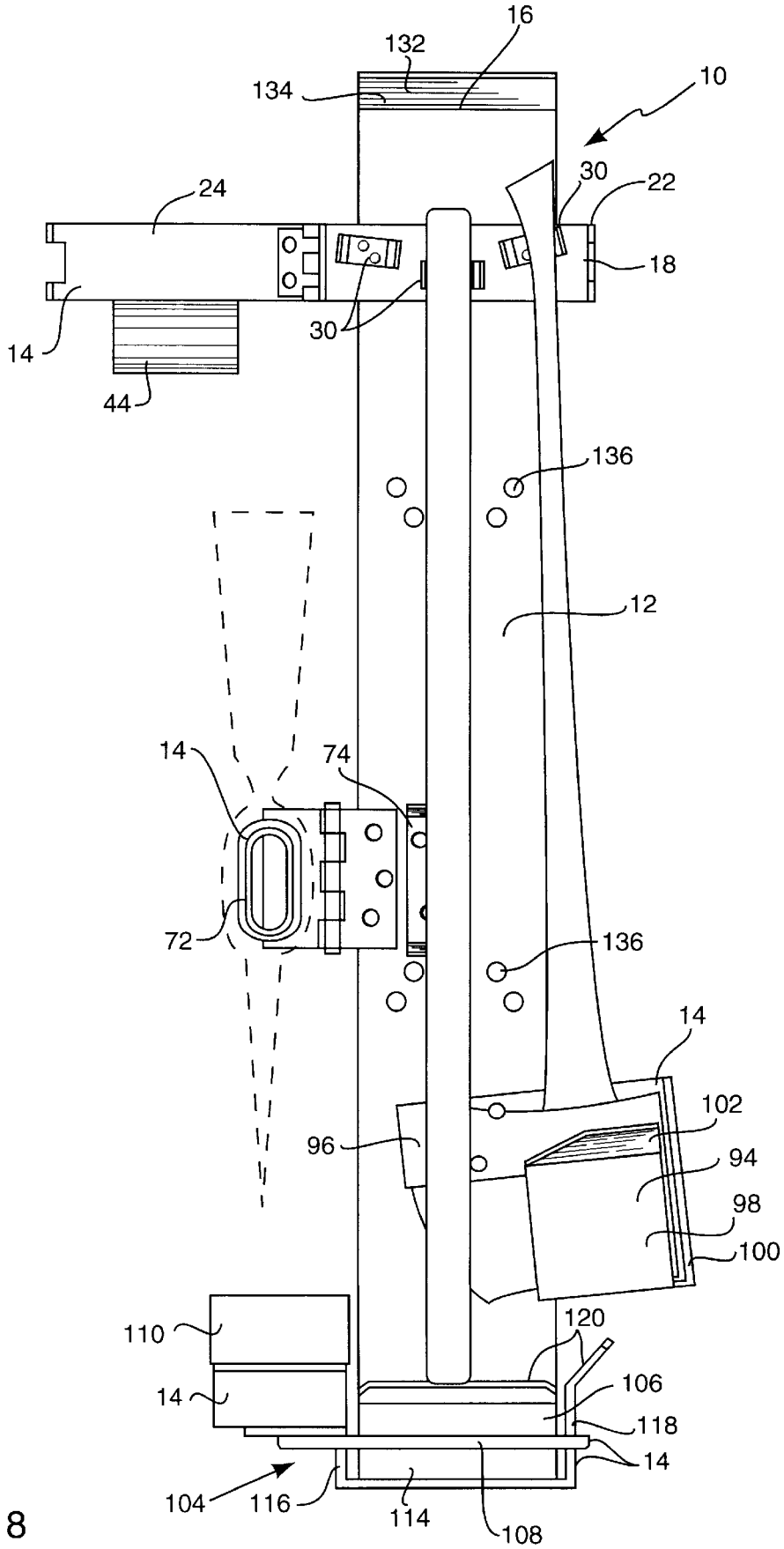
FIG. 8 is a view of the tool rack shown in FIG. 7, also showing the location of a mattock blade mounted within the mattock blade mount in its open position.
Figure 9:
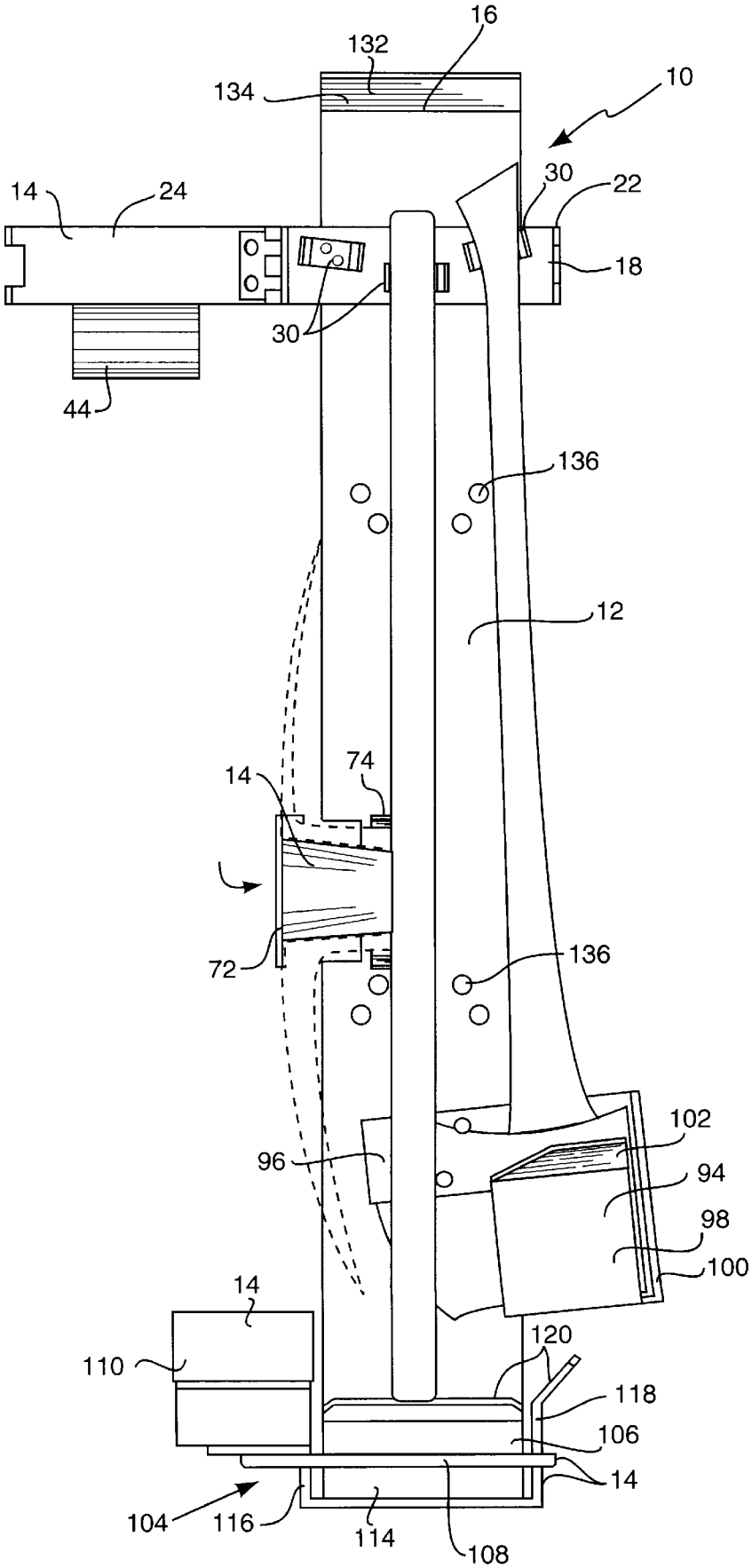
FIG. 9 is a view of the tool rack shown in FIG. 8, showing the mattock blade mounted within the mattock blade mount in its closed position.

As best seen in FIG. 4, mattock blade mount 72 consists of mattock clip 74, mattock hinge 76, and post 78. Mattock hinge 76 has a first plate 80 which is welded to backplate 12 and a second plate 82 which is welded to the base 84 of post 78. Mattock hinge 76 permits mattock blade mount 72 to rotate with respect to backplate 12 at least from a position where the base of post 84 lies parallel and adjacent to backplate 12 (as seen in FIGS. 1 and 2) to a position where plates 80, 82 of mattock hinge 76 are perpendicular with respect to one another (as seen in FIG. 4). For ease of mattock blade mounting, mattock hinge 76 may permit greater rotational freedom beyond the 90 degrees just described. Though post 78 may have a constant diameter slightly smaller than the diameter of a mattock blade hole, for better fit, post 78 preferably has an outer diameter 86 (see FIG. 4) which varies along its length, from a larger diameter at its base 84 to a smaller diameter at its top 88. This varying diameter is slightly smaller than the varying diameter of a mattock blade hole, allowing a mattock blade to be mounted over post 78 (see FIG. 8). To save on material cost and weight, post 78 is preferably hollow as shown in the figures. However, post 78 may instead be solid. Mattock clip 74 is spot welded to backplate 12 adjacent to mattock hinge 76. Like clips 30 in upper mount 18, mattock clip 74 is preferably made of 1/16" bent plate steel. Mattock clip 74 has a shape similar to clips 30, with clip arms 90 having facing concave surfaces and terminating in reverse bends 92. In use, a mattock blade is placed over post 78 in its open position shown in FIGS. 1 and 2. Post 78 (with mattock blade attached) is then rotated with second mattock hinge plate 82 to a position where the outer diameter of the mattock blade contacts reverse bends 92 of mattock clip arms 90. Further pressure placed by the mattock blade against mattock clip 74 spreads mattock clip arms 90 apart due to the shape of reverse bends 92. The mattock blade then "snaps" into place between mattock clip arms 90 as shown in FIG. 9. The resiliency and curved shape of mattock clip arms 90 secures the mattock blade firmly in place between mattock clip arms 90. Though mattock clip 74 is preferably made from steel, other materials (such as plastics, composites, or other metals) exhibiting the necessary strength, flexibility and resiliency may also be used.

Figure 5:
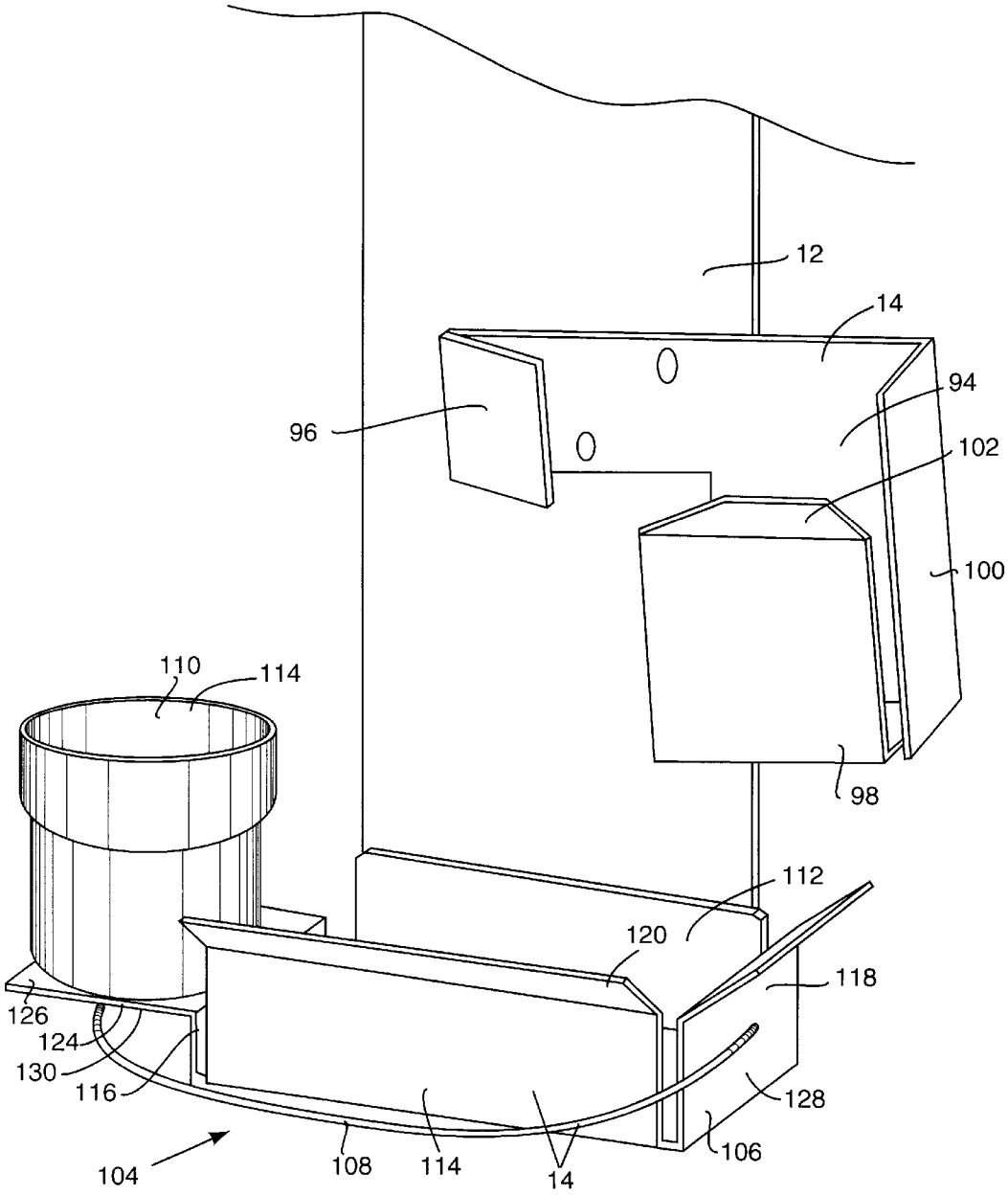
FIG. 5 is a closeup view of the lower mounts (an axe mount, a sledgehammer head mount, and a mattock handle mount) on the tool rack shown in FIGS. 1 and 2.

As best seen in FIG. 5, axe mount 94 is preferably formed from one piece of ⅛" bent plate steel. Axe mount 94 has three shrouds 96, 98, 100 bent from the same piece of plate steel: blade shroud 96 which is bent at a sharp angle to cover at least part of the blade of an axe mounted within axe mount 94, head shroud 98 which is bent to cup at least part of the head of the axe, and rear shroud 100 which is bent to cover at least part of the axe's rear face. The preferred positioning of an axe within axe mount 94 can best be seen in FIGS. 7 and 8. To best conform to the orientation of the axe head when the axe is mounted within tool rack 10, axe mount 94 is preferably spot welded to backplate 12 at an angle to the longitudinal axis of backplate 12 (see FIGS. 7 and 8). Head shroud 98 preferably terminates in an outward bend 102, the purpose of which will be described later.

Figure 11:
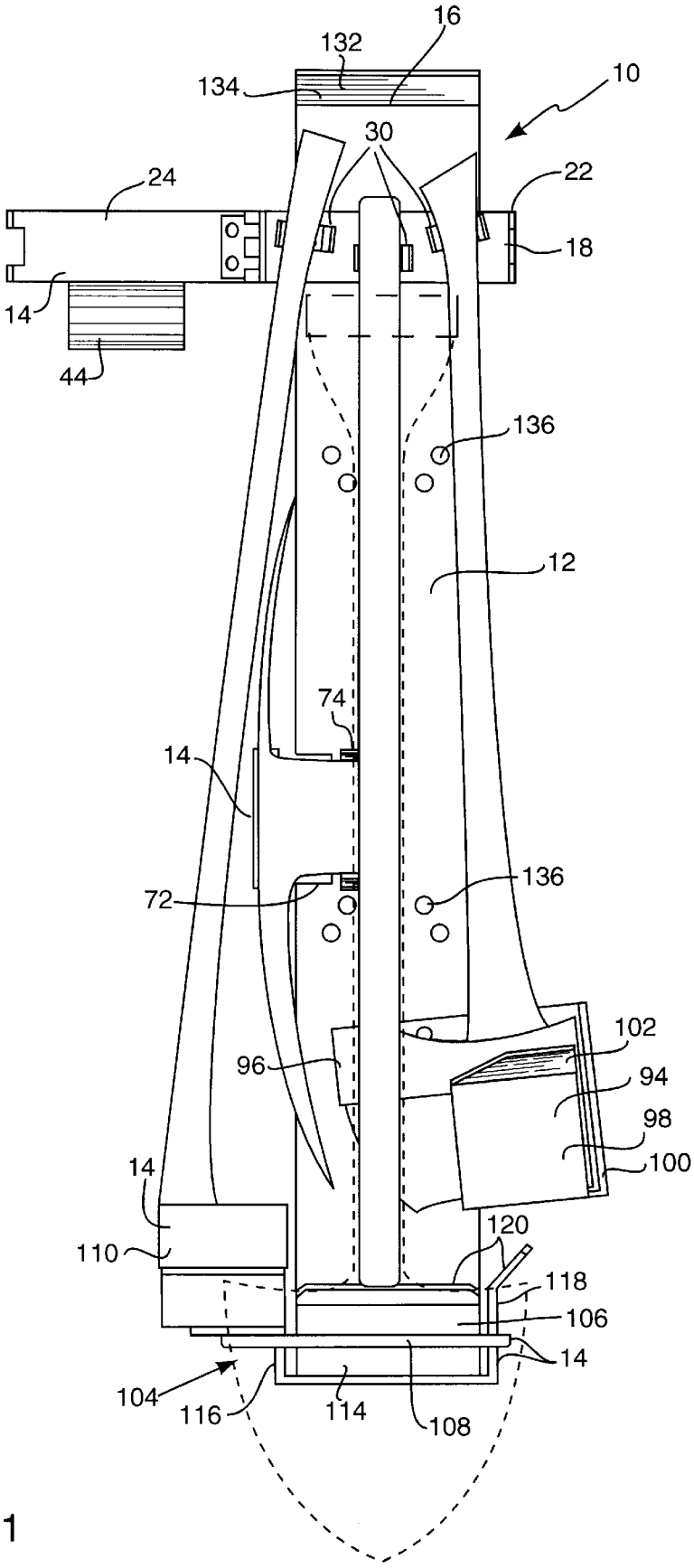
FIG. 11 is a view of the tool rack shown in FIG. 10, also showing the location of a shovel in its place within the tool rack.
Figure 12:
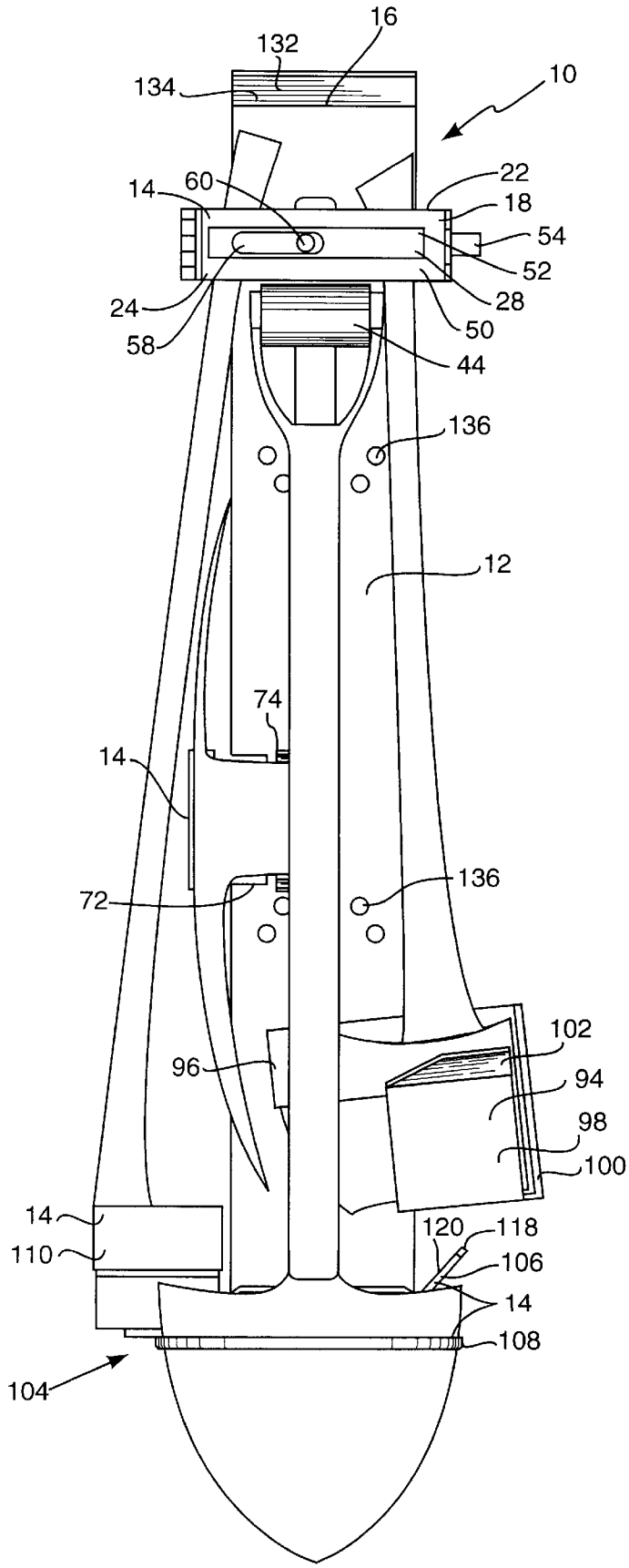
FIG. 12 is a view of the tool rack shown in FIG. 11, showing the hinged upper mount in its closed and secured position.

Also shown in FIG. 5 is a lower tool mount, indicated generally at 104. Lower tool mount 104 includes a sledgehammer head mount 106 which carries a sledgehammer head, a shovel blade mount 108 which carries the blade end of a shovel, and a mattock handle mount 110 which carries the blade end of a mattock handle. Like axe mount 94, sledgehammer head mount 106 is preferably made from one piece of ⅛" bent plate steel. Sledgehammer head mount 106 has facing side shrouds 112, 114 and front and rear shrouds 116, 118 covering the sides, front, and rear of a sledgehammer head when mounted within tool rack 10. While shrouds 112, 114, 116, and 118 are shown substantially covering the head of a sledgehammer (see FIG. 6), these shrouds need not necessarily cover the entire surfaces of the sledgehammer. Sledgehammer head mount 106 is attached to backplate 12 by spotwelding side shroud 112 to backplate 12. Side shroud 114 and rear shroud 118 are shown terminating in a outward bends 120, the purpose of which will be described later. Front shroud 116 is bent at a 90 degree angle to form shelf 124. Shelf 124 holds mattock handle mount 110, which is spot welded to the top surface 126 of shelf 124. Though shelf 124 is shown fully supporting mattock handle mount 110, shelf 124 need not necessarily extend fully beneath mattock handle mount 110. Shelf 124 need only extend far enough to provide adequate support for mattock handle mount 110. Mattock handle mount 110 is cup-shaped, and has a lower inner diameter of 2.75" and an upper inner diameter of 3.25". Mattock handle mount 110 holds the blade end of a mattock handle mounted within tool rack 10. Welded to the outer surface 128 of rear shroud 118 at one end and to the bottom surface 130 of shelf 124 at an opposite end is shovel blade mount 108. Shovel blade mount 108 is a ⅜" diameter steel rod bent in an arc which is bowed away from side shroud 114. As shown in FIGS. 11 and 12, the arc of shovel blade mount 108 rests against the blade of a shovel when mounted into tool mount 10.

Figure 6:
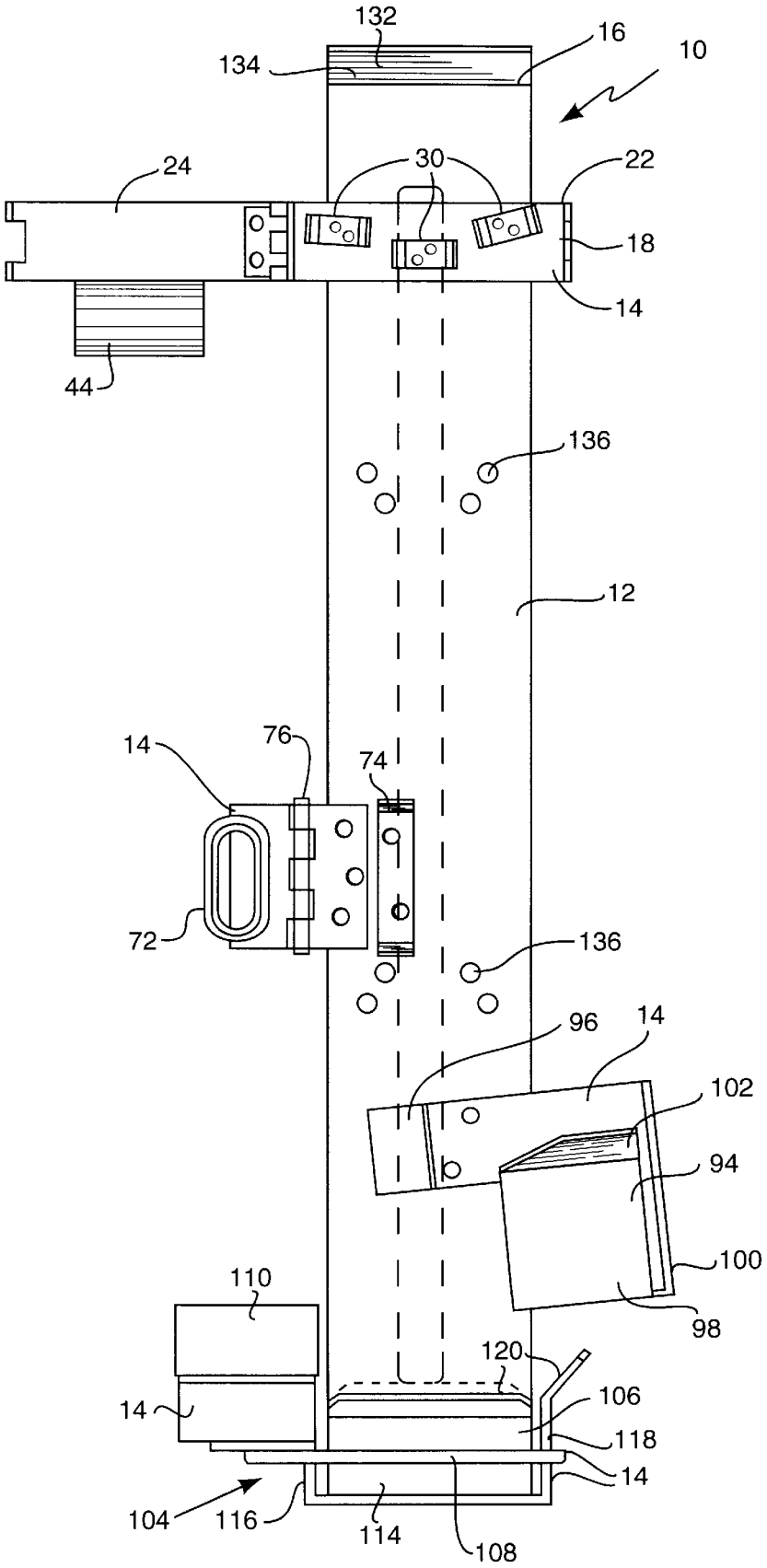
FIG. 6 is a view of the tool rack shown in FIG. 1, showing the location of a sledgehammer in its place within the tool rack.
Figure 7:
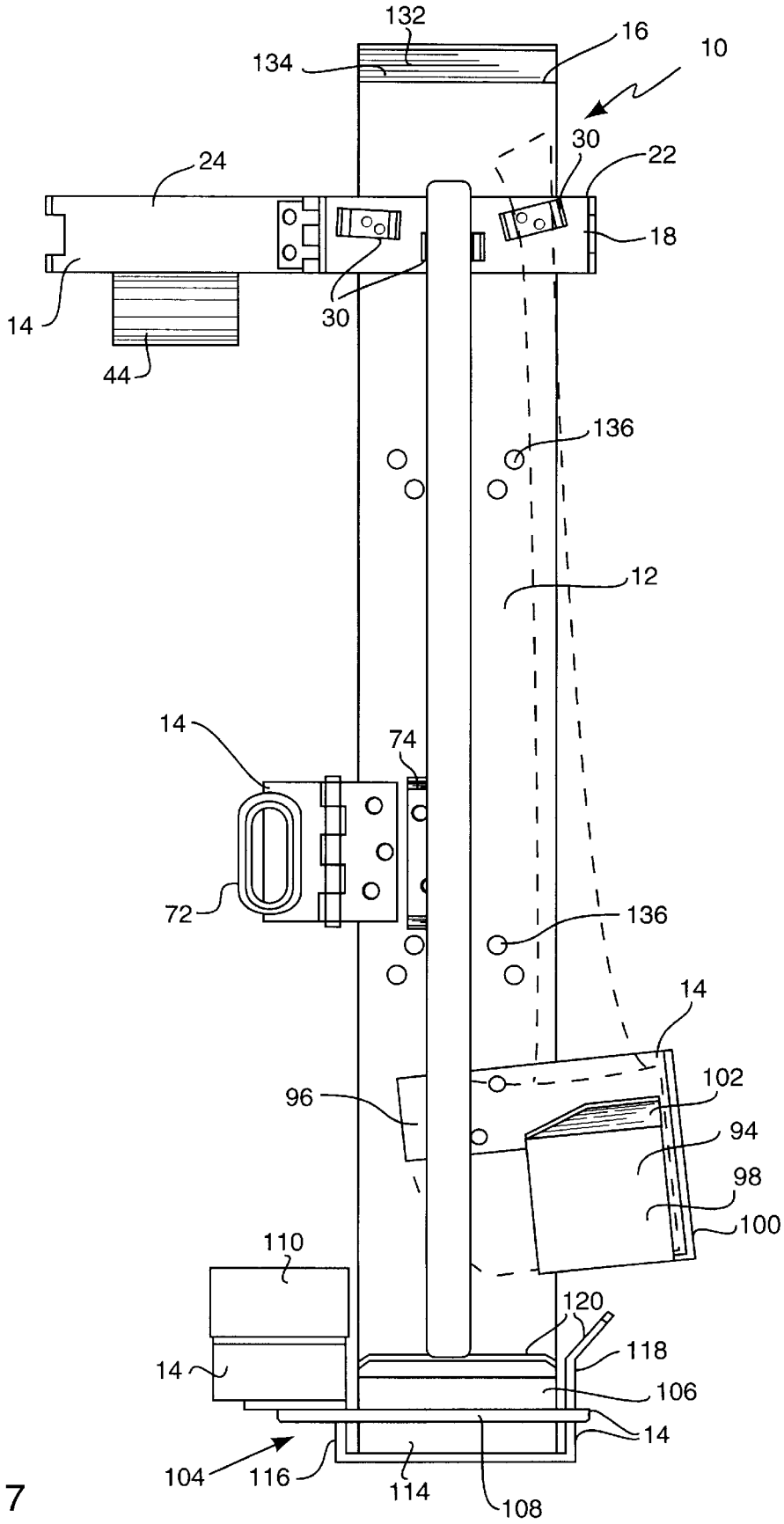
FIG. 7 is a view of the tool rack shown in FIG. 6, also showing the location of an axe in its place within the tool rack.
Figure 10:
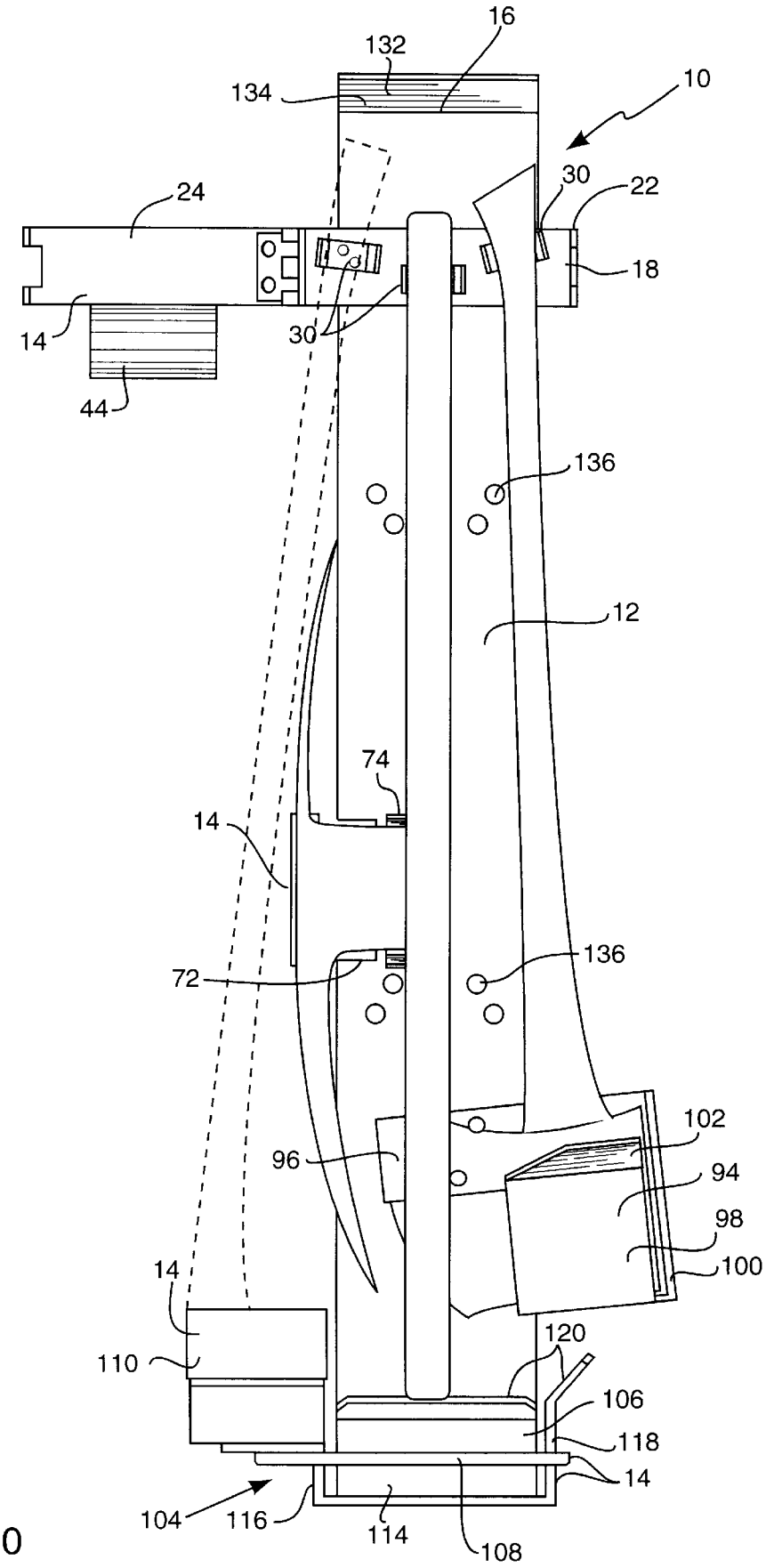
FIG. 10 is a view of the tool rack shown in FIG. 9, also showing the location of a mattock handle in its place within the tool rack.

Having described each tool mount 14 in detail, the preferred process for mounting tools within the preferred embodiment of the present invention will now be described. With reference to FIG. 6, where it can be seen that upper mount door 24 and mattock blade mount 72 are in their open positions, the head of a sledgehammer is first inserted within sledgehammer head mount 106, with the end of its handle then being secured within the center clip 30. Next, as shown in FIG. 7, the head of an axe is first inserted within axe mount 94, with the end of its handle then being secured within the right clip 30. Note in particular that by virtue of the arrangement and shape of tool mounts 14 on backplate 12, the heads of the sledgehammer and the axe are substantially covered either by shrouds 96, 98, 100, 112, 114, 116, and 118 or by another tool. Also, note that the location and placement of axe mount 94 on backplate 12 causes the blade of the axe to be located in the interior of tool rack 10. Next, as shown in FIG. 8, the blade of a mattock is placed within mattock blade mount 72, which is then clipped into position within mattock clip 74 when mattock blade mount 72 is rotated to its closed position (see FIG. 9). Note again that by virtue of the location and placement of mattock blade mount 72 on backplate 12, the sharp ends of the mattock blade are positioned within the interior of tool rack 10. As shown next in FIG. 10, the blade end of a mattock handle is placed within mattock handle mount 110, with the opposite end of the mattock handle then being secured within the left clip 30 of upper mount 18. In this manner, the mattock blade is further protected within tool rack 10 by another tool part (the mattock handle). Next, as shown in FIG. 11, the blade of a shovel is placed within shovel blade mount 108, with the handle of the shovel being laid over the head of the sledgehammer. In FIG. 12, door 24 is shown shut over enclosure 22, with bolt 54 of bolt assembly 28 being thrown. The curved lower end 44 of door 24 is aligned with and cups the handle of the shovel when door 24 is closed, thereby further securing the shovel in place within tool rack 10. Once again, it should be noted that by virtue of the placement and orientation of shovel blade mount 108 on tool rack 10, the working end of other tools (i.e., the axe blade and the sledgehammer head) are protected by the shovel. With door 24 shut over the mattock blade, shovel, sledgehammer, and axe handles, the mattock blade, shovel, sledgehammer, and axe may not be removed from tool rack 10. Specifically, door 24 prevents the lifting of these tools off of tool rack 10, while backplate flange 132 (see FIGS. 2 and 3) bent at a right angle to backplate 12 prevents these tools from being slid upward and out of their mounts. The removal of the mattock blade is prevented by the location of the mattock blade handle adjacent to the mattock blade, preventing the rotation of mattock blade mount 72 and the mattock blade to release the mattock blade from tool rack 10. The tools within tool rack 10 may be secured against theft by locking bolt assembly 28 with a lock placed through shackle hole 56.

In the manner of tool mount arrangement described above with regard to the preferred embodiment of the present invention, it can be seen that the heads and blades of a number of the tools mounted within tool rack 10 are protected either by tool mount shrouds or by other tools. For example, the axe blade and sledgehammer head are protected by shrouds 96, 98, and 100, 112, 114, 116, 118, respectively, while the sledgehammer head, axe blade, and mattock blade are also protected by neighboring tools by virtue of their arrangement (and tool mount 14 arrangement and orientation) with respect to other tools in tool rack 10. The present invention therefore protects not only the tools mounted within tool rack 10, but also increases the safety of those working around tool rack 10. The tool arrangement offered by tool mounts 14 and the tool mount arrangement on backplate 12 also minimizes the space required to securely store the tools.

As shown in FIGS. 1–3, the top of backplate 12 terminates in an angled bend. This bend 134 serves the same purpose as outward bend 102 of axe mount 94, outward bends 120 of sledgehammer head mount 106, and the larger upper diameter of mattock handle mount 110. All of these features serve to guide the tools within their respective tool mounts 14 when the tools are being mounted into tool rack 10. With the outward bends 102, 120 and the larger mattock handle mount diameter, the tools being mounted within tool rack 10 need not be in exact registry with their respective tool mounts 14 to be secured within the tool mounts 14. Outward bends 102, 120 and the larger mattock handle mount diameter help to guide the tools to the correct position with respect to the tool mounts 14 during the mounting procedure. These features offer faster mounting of tools within the tool rack, which can sometimes be a necessity for users. In particular, the time savings realized by these features can make a tremendous difference in a hostile or emergency environment, where the need for time savings runs in seconds rather than minutes (e.g., where the tool rack of the present invention is used on military vehicles in a combat situation or on firefighting vehicles during a forest fire).

Another feature of the present invention is shown in FIG. 5. As a safety feature against injury to those near tool rack 10, outward bend 102 of head shroud 98 of axe mount 94 is provided with beveled corners. As an increased safety feature of the present invention, all sharp edges of backplate 12 and tool mounts 14 may also be replaced by beveled corners.

Figure 13:
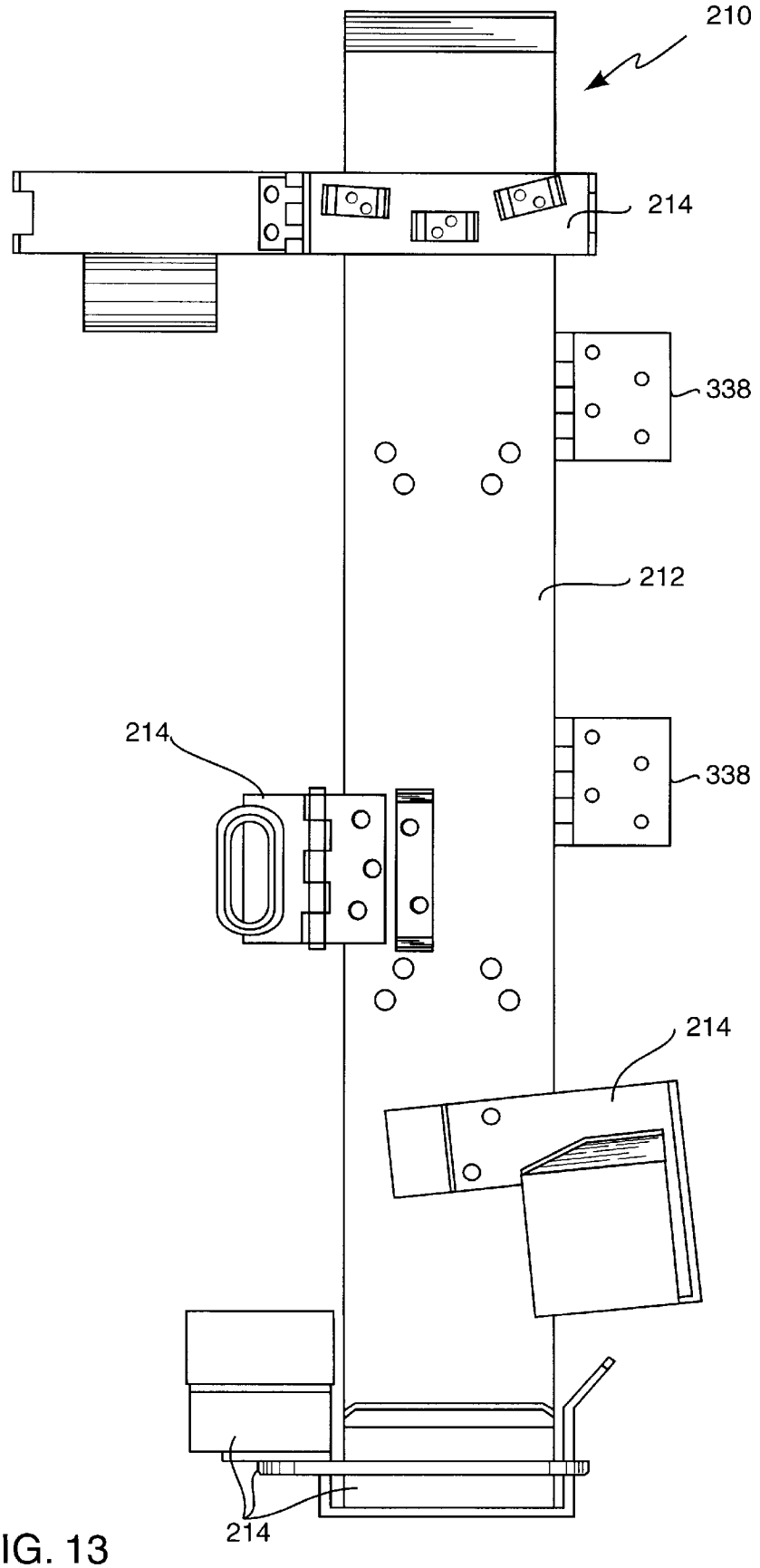
FIG. 13 is a front view of a second embodiment of the present invention which is substantially the same as the preferred embodiment shown in FIG. 1 but which also includes mounting hinges on the tool rack.

The tool rack of the present invention may be mounted on any number of surfaces and locations, and does not require a specific mounting orientation. For example, the tool rack of the present invention may be secured vertically or horizontally, tools facing up, down, or sideways. The tool rack of the present invention may be secured to a non-moving structure (such as a fence, building wall, etc.) or to any number of locations on a vehicle (such as the side of an emergency vehicle, in the bed of a truck, or to the underside of a semi-trailer). For this purpose, mounting holes 136 are provided in backplate 12, through which securing elements such as bolts may be passed which are themselves attached to a structure or vehicle. As shown in FIG. 13, where it is necessary to be able to swing tool rack 210 into a more accessible position to mount or remove tools from tool rack 210 (such as when tool rack 210 is mounted beneath a semi-trailer bed), hinges 338 may be welded to backplate 212 and attached to the structure or vehicle.

It will be obvious to those skilled in the art that various changes may be made in the device of the present invention without departing from the spirit of the invention and therefore the invention is not to be understood as limited to what is shown in the drawings and described in the specification, since these may be modified within the scope of the appended claims without departing from the spirit and scope of the invention. For example, throughout the description above of the preferred embodiment of the present invention, various elements are described as being attached by welding or by spot welding. While this is the preferred method of attachment in the embodiment described, other methods of attachment are possible, such as by bolting, screwing, gluing, nailing, tying, or riveting. The method of attachment chosen will of course vary depending upon the materials used to made backplate 12, 212 and tool mounts 14, 214 and upon the anticipated conditions and uses of tool rack 10, 210. Also, the preferred embodiment described above is with reference to a tool rack holding four tools: a sledgehammer, an axe, a mattock, and a shovel. Other tool racks holding and securing fewer or more of the same or different types of tools and embodying the features and elements of the present invention are also possible.

What is claimed is:

1. A tool rack for holding a plurality of tools each having a tool head and a tool handle, said tool rack comprising:

a plurality of tool mounts, said plurality of tool mounts each being fixed in place with respect to one another, said tool mounts securably holding said tools in place on said tool rack, wherein at least one of said tool heads is substantially enclosed by a tool mount, tool head, or tool handle within said tool rack, wherein at least one tool mount is provided with a shroud which substantially covers a head of a tool mounted within said at least one tool mount; and wherein a terminal portion of said shroud is bent to guide tools into the at least one tool mount when being mounted within said tool rack.

2. A tool rack for holding a tool, said tool rack comprising:

a first tool mount; and a second tool mount secured at a fixed distance away from said first tool mount, at least a portion of said first tool mount being rotatable via a hinge from an unsecured position to a secured position, wherein said first tool mount and said second tool mount are secured to a backplate, and wherein at least one hinge is secured to said backplate to rotatably secure said backplate to a structure.

3. A tool rack for holding a tool, said tool rack comprising:

a first tool mount; and a second tool mount secured at a fixed distance away from said first tool mount, at least a portion of said first tool mount being rotatable via a hinge from an unsecured position to a secured position, wherein said first tool mount comprises a post which is adapted to receive a handle hole of a mattock blade, said post being hinged to swing from said unsecured position to said secured position.

4. The tool rack as claimed in claim 3, wherein said first tool mount further comprises a clip which securably receives said mattock blade when said post is in said secured position.

5. A tool rack for holding a tool, said tool rack comprising:

a first tool mount; and a second tool mount secured at a fixed distance away from said first tool mount, at least a portion of said first tool mount being rotatable via a hinge from an unsecured position to a secured position, wherein at least one of said first and second tool mounts is provided with a shroud shaped to cover at least a portion of a head of a tool mounted within said tool rack, and wherein said shroud terminates in an end bent away from a tool installed within said tool rack.

6. A tool rack for holding a sledgehammer, axe, mattock, and shovel, said tool rack comprising:

a first tool mount; and a second, third, fourth, and fifth, and sixth tool mount secured at a distance from said first tool mount, said first tool mount having three U-shaped clips secured thereto and adapted to securably receive handles of said sledgehammer, axe, and mattock;

said second tool mount having a fourth U-shaped clip and a hinged post shaped to receive a handle hole of a blade of said mattock, said third, fourth, and fifth tool mounts having shrouds defining sides of said third, fourth, and fifth tool mounts and being shaped to receive a head of said axe, a head of said sledgehammer, and a blade end of said mattock handle, respectively, said fifth tool mount including a bent rod secured to said tool rack and shaped to hold a blade of said shovel.

7. The tool rack as claimed in claim 6, wherein said first tool mount also includes a hinged door which may be closed, bolted, and locked over handles of said tools.

8. The tool rack as claimed in claim 6, wherein said shrouds terminate in bends which guide tools into said third, fourth, and fifth tool mounts during mounting of said tools.

9. A method for storing a tool within a tool rack, said method comprising the steps of:

(a) securing a head of a tool within a first tool mount secured to said tool rack, said first tool mount being shrouded to cover a substantial part of said head;

(b) securing a handle of said tool within a second tool mount secured to said tool rack; and (c) rotating and securing a part of said second tool mount into position over said tool.

10. The method as claimed in claim 9, wherein said second tool mount includes at least one U-shaped clip adapted to securably receive a tool handle.

11. The method as claimed in claim 9, wherein steps (a) through (c) are repeated for other tools subsequently inserted within said tool rack.

12. The method as claimed in claim 11, wherein at least one tool is installed within said tool rack in a position shielding at least a part of a head of another tool within said tool rack.

13. The method as claimed in claim 9, wherein when said part of said first tool mount is rotated and secured into position over said tool, said tool may not be removed from said tool rack.

14. The method as claimed in claim 9, wherein said tool rack further includes a mattock clip and associated hinged post for mounting a mattock blade thereon, said hinged post being rotated to securably mount a mattock blade into said mattock clip in a mounted position.

15. The method as claimed in claim 14, wherein said hinged post is prevented from rotating from said mounted position by mounting of a mattock handle within tool mounts in said tool rack.

* * * * *